United States Patent [19]

Dadley et al.

[11] Patent Number: 4,693,181

[45] Date of Patent: Sep. 15, 1987

[54] LINEAR CUTTING CHARGE

[75] Inventors: David A. Dadley, Sevenoaks; Peter J. Haskins, Kemsing, both of England

[73] Assignee: Royal Ordnance plc, London, England

[21] Appl. No.: 548,672

[22] Filed: Oct. 17, 1983

[51] Int. Cl.[4] ..... F42B 1/00

[52] U.S. Cl. ..... 102/307; 102/308; 149/14; 149/15; 149/19.3; 149/92; 264/3.2; 264/3.3

[58] Field of Search ..... 102/307, 308; 149/92, 149/19.3, 14, 15; 264/3 C

[56] References Cited

U.S. PATENT DOCUMENTS 3,688,702 9/1972 Prior et al. ..... 102/308 X 4,327,642 5/1982 Grosse-Benne et al. ..... 102/308 X

*Primary Examiner*—Stephen J. Lechert, Jr.

*Attorney, Agent, or Firm*—William R. Hinds

[57] ABSTRACT

The application discloses improvements in hollow charges for linear cutting or demolition purposes wherein a bar formed from a composite of explosive material and a first pliant material has a V-shaped groove with a liner formed from a composite of particulate metal and a second pliant material. The metal may be copper and preferably the first and second pliant materials include the same constituents. The charge may include a casing having a spacing portion having an engagement surface for presentation to a work surface, which engagement surface is parallel to the outer edges of the liner and spaced therefrom to maintain an optimum stand-off distance. The casing may further include a groove filling portion of low density material which may be integrally constructed with the casing from a flexible material such as expanded polyethylene.

15 Claims, 3 Drawing Figures

LINEAR CUTTING CHARGE

Figure 1:
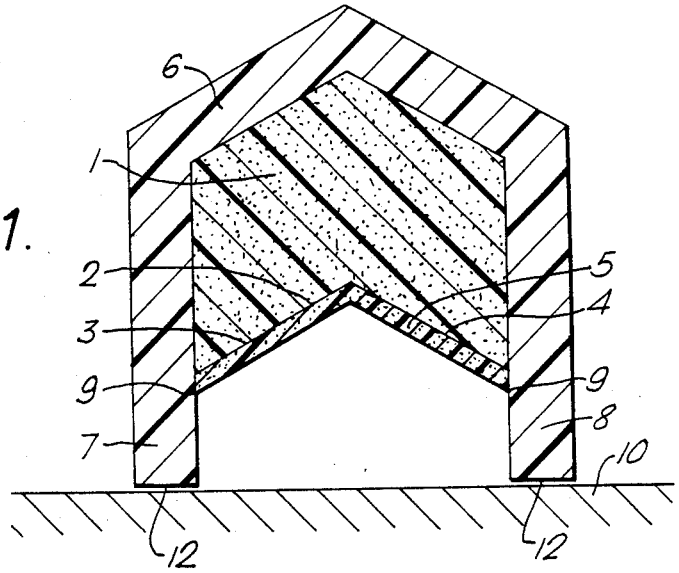

This invention relates to a hollow charge for linear cutting purposes.

Hollow charges are known comprising a mass of explosive having a variously shaped cavity at one of its surfaces, the cavity being lined with a metal liner. Detonation of the charge violently compresses the metal liner converting it into an outwardly projected slug of metal, the shape of which is dependent upon the shape of the cavity. The slug has powerful penetrating properties which are utilized by detonating the charge with its cavity adjacent and facing a surface to be penetrated, i.e. the work surface. The penetration of the slug is dependent on the separation of the charge from the work surface, i.e. the stand-off distance, the optimum value of which is normally determined by experiment.

One particular example of a hollow charge known for linear cutting purposes comprises an elongated mass of explosive material having a cavity in the form of a V-shaped groove along its length, which mass is encased by a thin walled metal casing. Detonation produces a planar slug along the length of the groove which can be utilized for linear cutting. In a known method of manufacture of such linear cutting charges, a lead tube is packed with explosive granules and then passed through a series of rollers arranged to form the packed tube into a bar of chevron cross-section thereby forming a lead-lined, V-shaped groove along the length of the bar. The thickness of the lead wall encasing the two outer apices of the V-shaped groove is relied upon to space the charge from the work surface and thus defines the stand-off distance. Linear cutting charges so produced often have a non-uniform wall thickness and when these non-uniformities occur at the stand-off region or in the lining of the groove, variations in cutting efficiency and a lack of uniformity in cutting power results.

The present invention seeks to provide a linear cutting charge having a construction conducive to accurate and uniform formation of its effective dimensions.

According to the present invention a linear cutting charge includes an explosive mass formed in the shape of a bar from a composite of explosive material and a first pliant material, the bar having a groove extending longitudinally along one of its faces, within which groove is located a liner formed from a composite of particulate metal and a second pliant material.

Preferably, both the bar and the liner may be formed by extrusion, but formation may also be by other techniques, e.g. moulding or rolling.

The particulate metal may advantageously be copper.

The first and second pliant materials are chosen to be chemically compatible with the explosive material and are preferably identical.

Preferably, the groove has an outwardly widening, triangular cross-section and both the bar and the liner may be of chevron cross-section, the liner being bonded to the bar so as to cover the surfaces of the groove.

Preferably the linear cutting charge further includes a casing which may advantageously be substantially rigid to prevent distortion of the bar and the liner during handling, which casing may advantageously include a spacing portion having an engagement surface for presentation to a work surface, which engagement surface is parallel to the outer edges of the liner and spaced therefrom, thereby to maintain an optimum stand-off distance. Alternatively the casing may be flexible to facilitate cutting of curved surfaces and curved lines.

When the flexible charge is intended for cutting curved lines in a planar surface, stiffening means may be advantageously included, which may comprise metallic strips embedded in the casing normal to the engagement surface and extending longitudinally on either side of the groove, whereby the bending of the linear cutting charge may be limited to lateral bending parallel with the engagement surface.

The presence of dense material in the groove is detrimental to cutting efficiency and therefore the casing may advantageously include a groove filling portion of low density material to prevent the influx of dense material when, for example, the linear cutting change is used under water.

Conveniently, the casing including the spacing portion and the groove filling portion may be integrally constructed from a low density flexible material such as expanded polyethylene.

Figure 2:
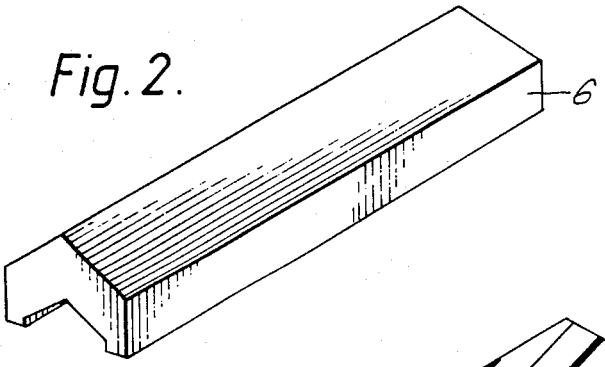
Figure 3:
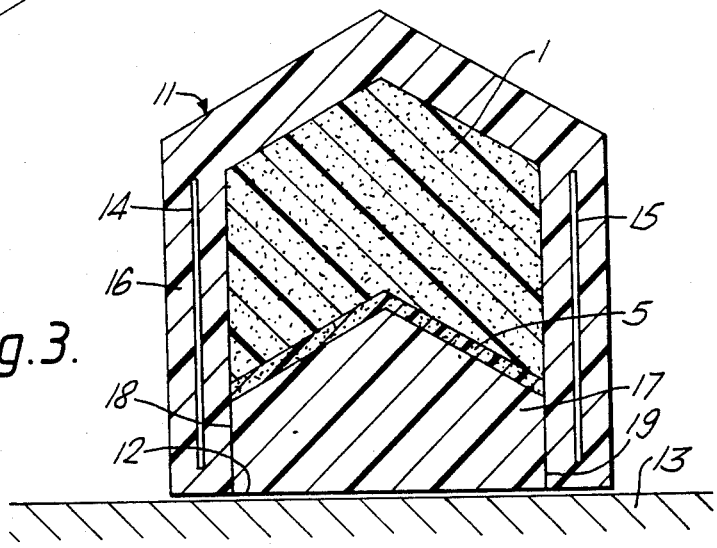

Embodiments of the invention will now be described by way of example only with reference to the accompanying drawings of which FIG. 1 is a transverse section of a flexible linear cutting charge, FIG. 2 is an oblique view of the whole linear cutting charge of FIG. 1 and FIG. 3 is a transverse section of a flexible linear cutting charge having stiffening means.

The linear cutting charge of FIGS. 1 and 2 has an explosive bar 1 of chevron cross-section having a groove 2 defined by the intersecting surfaces 3 and 4 which are included one to the other at an angle of 120 degrees.

The bar 1 is formed by extrusion from a pliant mixture of 88% by weight of RDX (Cyclotrimethylenetrinitramine), 8.4% PIB (Polyisobutylene), 2.4% DEHS (2 (Diethylhexyl) sebacate), and 1.2% PTFE (polytetrafluroethylene).

The thickness of the bar measured in a direction normal to either of the faces 3 or 4 is 6.35 mm. A V-section linear 5 of 0.635 mm thickness formed by extrusion from a pliant mixture of 85% by weight of 300 mesh copper powder and 5.6% PIB, 1.6% DEHS and 7.8% PTFE, is bonded to the surfaces 3 and 4 by pressure.

A flexible casing 6 of expanded polyethylene surrounds the bar 1 except for the groove 2 and includes spacing portions 7 and 8 which protrude beyond the edges 9 of the liner 5 by a distance of 3.8 mm which, for this configuration, is the optimum stand-off distance between the edges 9 and an engagement surface 12 presented to a work surface 10. The casing 6 and the bar 1 are bonded together by a compatible adhesive.

The explosive bar 1 may conveniently be initiated by an electrically operated detonator (not shown) which may be affixed externally to the casing at one end of the linear cutting charge.

A second embodiment of the invention is illustrated in FIG. 3 in which the bar 1 and liner 5 described with reference to FIGS. 1 and 2 are surrounded entirely by a casing 11 of a low density material such as expanded polyethylene having an engagement surface 12 which is placed in contact with a work surface 13. The casing 11 comprises a first portion 16 which is substantially the same as the casing 6 of FIG. 1 and a groove filling portion 17 which is bonded to the first portion 16 at surfaces 18 and 19 by a suitable adhesive.

Stiffening means comprising metallic strips 14 and 15 are embedded in the casing 11 on either side of the groove 2 and normal to the engagement surface 12, thereby limiting bending of the linear cutting charge to lateral bending parallel to the plane of the engagement surface 12.

It will be apparent to those skilled in the art that various other arrangements of the present invention are possible. For example, the casing may be of a rigid material such as polystyrene, and any casing may or may not include a groove filling portion. A groove filling portion may alternatively comprise a thin walled, air filled compartment, thereby excluding material from the groove and providing minimal resistance to the cutting slug generated by detonation of the charge.

We claim:

1. A linear cutting charge including an explosive mass formed in the shape of a bar from a composite of explosive material and a first pliant material, the bar having a groove extending longitudinally along one of its faces, within which groove is located a liner formed from a composite of particulate metal and a second pliant material.

2. A charge as claimed in claim 1 wherein either one of the bar and the liner is formed by extrusion.

3. A charge as claimed in claim 1 wherein said particulate metal is copper.

4. A charge as claimed in claim 1 wherein the first pliant material and the second pliant material have the same constituents.

5. A charge as claimed in claim 4 wherein the constituents are PIB (Polyisobutylene), DEHS (2 (Diethylhexyl) sebacate), and PTFE (polytetrafluroethylene).

6. A charge as claimed in claim 1 further including a casing open at the groove and having an engagement surface peripheral to the groove, which engagement surface is presented in use to a work surface.

7. A charge as claimed in claim 6 wherein said casing extends beyond the groove to produce a spacing portion whereby the engagement surface is spaced from the outer edges of the liner by a predetermined stand-off distance.

8. A charge as claimed in claim 6 wherein said casing includes a groove filling portion of a low density material.

9. A charge as claimed in claim 8 wherein said groove filling portion and said casing are of integral construction.

10. A charge as claimed in claim 1 wherein the groove has an outwardly widening, triangular cross-section.

11. A charge as claimed in claim 10 wherein both said bar and said liner are of chevron cross-section.

12. A charge as claimed in claim 6 wherein the casing is substantially rigid.

13. A charge as claimed in claim 6 wherein the casing is flexible.

14. A charge as claimed in claim 13 including stiffening means comprising metal strips embedded in the casing normal to the engagement surface and extending longitudinally on either side of the groove, whereby bending of the bar is substantially limited to lateral bending parallel with the engagement surface.

15. A charge as claimed in claim 13 wherein the casing is of expanded polyethylene.

* * * * *